US007958837B1

(12) United States Patent
Fraleigh

(10) Patent No.: US 7,958,837 B1
(45) Date of Patent: Jun. 14, 2011

(54) MULTIPLE TRIM MODULATION SYSTEM

(75) Inventor: John E. Fraleigh, Kiln, MS (US)

(73) Assignee: John E Fraleigh, Kiln, MS (US)

( * ) Notice: Subject to any disclaimer, the term of this patent is extended or adjusted under 35 U.S.C. 154(b) by 5 days.

(21) Appl. No.: 12/340,900

(22) Filed: Dec. 22, 2008

Related U.S. Application Data

(60) Provisional application No. 61/011,709, filed on Jan. 22, 2008.

(51) Int. Cl.
*B63B 1/22* (2006.01)

(52) U.S. Cl. ..... 114/285; 440/61 T

(58) Field of Classification Search ..... 114/285–287; 440/61 T
See application file for complete search history.

(56) References Cited

U.S. PATENT DOCUMENTS

| | | | | |
|---|---|---|---|---|
| 3,695,204 | A | 10/1972 | Bennett | |
| 4,644,893 | A | 2/1987 | Zepp | |
| 4,854,259 | A | 8/1989 | Cluett | |
| 5,113,780 | A | 5/1992 | Bennett et al. | |
| 5,383,419 | A | 1/1995 | Stevens | |
| 5,385,110 | A | 1/1995 | Bennett et al. | |
| 5,704,308 | A * | 1/1998 | Anderson | 114/285 |
| 6,354,237 | B1 | 3/2002 | Gaynor et al. | |
| 7,037,150 | B2 | 5/2006 | Morvillo | |
| 7,311,058 | B1 | 12/2007 | Brooks et al. | |
| 2007/0277721 | A1 * | 12/2007 | Crotts | 114/144 R |

OTHER PUBLICATIONS

Trim Tabs, <available at http://vppneuapps.volvo.com/ww/QL/ql.asp> retrieved Dec. 19, 2008, 1 page.

* cited by examiner

*Primary Examiner* — Stephen Avila

(57) ABSTRACT

A multiple trim modulation system for efficiently and simultaneously controlling multiple trim devices upon a marine vessel. The multiple trim modulation system generally includes a plurality of trim devices movably mounted to a watercraft and a controller adapted to control the plurality of trim devices. The controller includes a plurality of adjustment modes, wherein each of the plurality of adjustment modes moves the plurality of trim devices in a simultaneous manner. The plurality of trim devices either move towards a similar direction or move towards an opposing direction depending on a corresponding mode of the plurality of adjustment modes.

14 Claims, 11 Drawing Sheets

MULTIPLE TRIM MODULATION SYSTEM

CROSS REFERENCE TO RELATED APPLICATIONS

I hereby claim benefit under Title 35, United States Code, Section 119(e) of U.S. provisional patent application Ser. No. 61/011,709 filed Jan. 22, 2008. The 61/011,709 application is currently pending. The 61/011,709 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to marine vessels including multiple trim devices and more specifically it relates to a multiple trim modulation system for efficiently and simultaneously controlling multiple trim devices upon a marine vessel.

2. Description of the Related Art

Any discussion of the related art throughout the specification should in no way be considered as an admission that such related art is widely known or forms part of common general knowledge in the field.

Watercraft, such as a boat that includes multiple trim devices, have been in use for years. A watercraft may include multiple trim devices for various reasons, such as when the trim devices are comprised of propulsion units to power larger watercrafts or to simply help the watercraft maneuver through rough waters or in general. Trim devices may be comprised of various configurations, such as but not limited to trim tabs, outboard motors including a motor trim function, inboard/outboard motors including a motor trim function, and jet drives including a motor trim function. The trim devices generally adjust the position and attitude of the watercraft relative to the body of water on which they are operating by adjusting an angle of the trim device with respect to the watercraft. Some specific functions of trim devices are to lower or raise the bow of the watercraft, or to adjust the "roll" of the port or starboard side (i.e. rolling left or right) of the watercraft with respect to the other.

Typical control systems for trim devices include rocker switches for each trim device and thus require the operator to push multiple up or down controls simultaneously in order to raise or lower all of the trim devices or to control the roll of the watercraft by manipulating one of the trim devices differently than another. This can be difficult to operate multiple switches simultaneously, especially when the operator is also concerned with other factors when operating the watercraft, such as steering and monitoring the depth of the body of water. Because of the inherent problems with the related art, there is a need for a new and improved multiple trim modulation system for efficiently and simultaneously controlling multiple trim devices upon a watercraft.

BRIEF SUMMARY OF THE INVENTION

The general purpose of the present invention is to provide a multiple trim modulation system that has many advantages over the present ways to control the adjustment of multiple trim devices mentioned heretofore. The invention generally relates to a marine vessel including multiple trim devices which includes a plurality of trim devices movably mounted to a watercraft and a controller adapted to control the plurality of trim devices. The controller includes a plurality of adjustment modes, wherein each of the plurality of adjustment modes moves the plurality of trim devices in a simultaneous manner. The plurality of trim devices either move towards a similar direction or move towards an opposing direction depending on a corresponding mode of the plurality of adjustment modes.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a multiple trim modulation system for efficiently and simultaneously controlling multiple trim devices upon a marine vessel.

Another object is to provide a multiple trim modulation system that may connect to preexisting control systems that are previously utilized as the source to control the trim devices.

An additional object is to provide a multiple trim modulation system that may be utilized and configured to control various numbers of trim devices (i.e. two or more trim devices).

A further object is to provide a multiple trim modulation system that is easy to operate.

Another object is to provide a multiple trim modulation system that may be utilized with various types of actuating means that are utilized to maneuver the trim devices, such as electrical actuators or hydraulic actuators.

Another object is to provide a multiple trim modulation system that may utilize many of the preexisting switches or controls upon a boat or motor unit.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
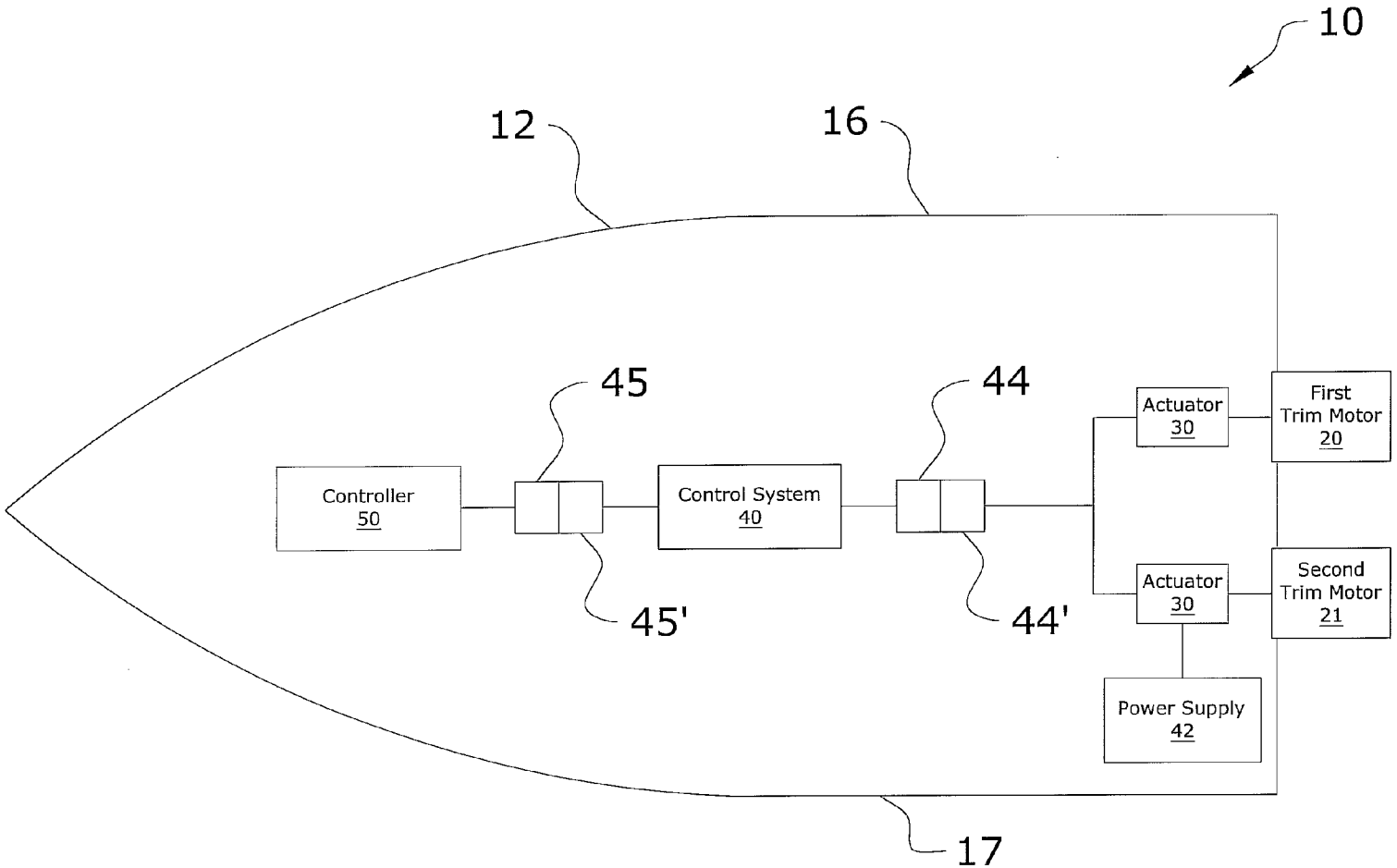
FIG. 1 is a schematic representation of the preferred embodiment of the present invention retrofitted to a watercraft.

Turning now descriptively to the drawings, in which similar reference characters denote similar elements throughout the several views, FIGS. 1 through 12 illustrate a multiple trim modulation system 10, which comprises a plurality of trim motors 20, 21 and/or a plurality of trim tabs 22, 23. The trim motors 20, 21 and/or trim tabs 22, 23 are herein referred as trim devices. The trim motors 20, 21 and/or trim tabs 22, 23 are movably mounted to a watercraft 12 and a controller 50 adapted to control the trim motors 20, 21 and/or trim tabs 22, 23. The controller 50 includes a plurality of adjustment modes 52, 53, 54, 55, wherein each of the plurality of adjustment modes 52, 53, 54, 55 moves the trim motors 20, 21 and/or trim tabs 22, 23 in a simultaneous manner. The trim motors 20, 21 and/or trim tabs 22, 23 either move towards a similar direction or move towards an opposing direction depending on a corresponding mode of the plurality of adjustment modes 52, 53, 54, 55. It is appreciated that there could be an infinite number of modes depending on how and to what degree the boat or watercraft is desired to be adjusted.

It is appreciated that the controller 40 preferably either controls all of the trim motors 20, 21 or all of the trim tabs 22, 23 in a simultaneous manner and not both the trim motors 20, 21 and trim tabs 22, 23 in a simultaneous and independent manner. However, the present invention may include multiple controllers 40, 40' and control systems 50, 50' to control both of the trim motors 20, 21 and trim tabs 22, 23 at the same time. It is appreciated that various components of the present invention may also be retrofitted to existing watercraft 12.

B. Watercraft

The preferred embodiment is preferably installed upon a watercraft 12, such as but not limited to a boat, a marine vessel or various other types of watercraft 12. The watercraft 12 includes a hull 14 (e.g. catamaran, V-shaped hull, etc.), a port side 17 and a starboard side 16 as standard in the prior art as illustrated in FIG. 1.

C. Trim Devices

Figure 7:
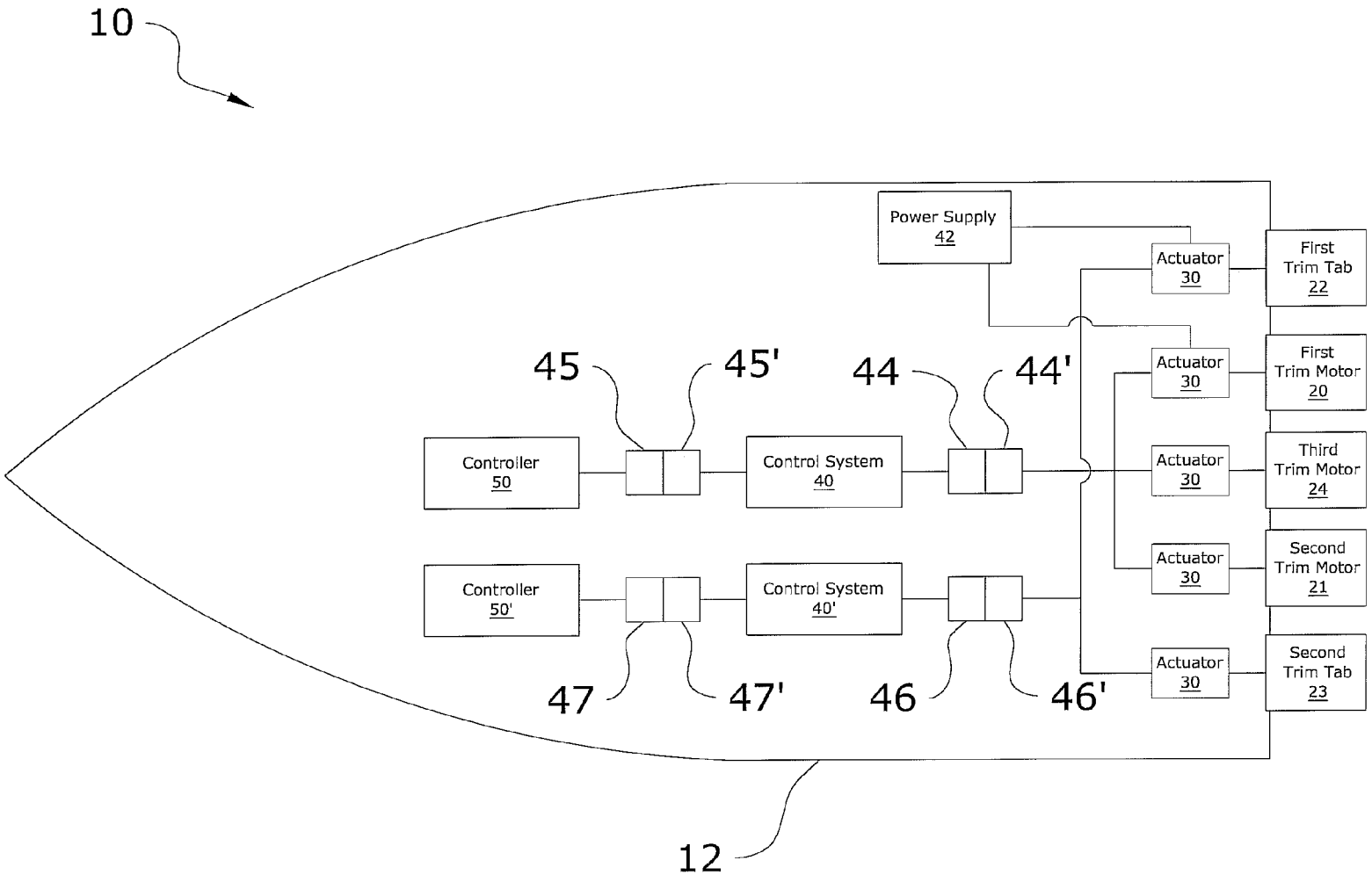
FIG. 7 is a block diagram of an alternate embodiment of the present invention retrofitted to a watercraft and including a plurality of trim tabs and motor trim units.
Figure 8:
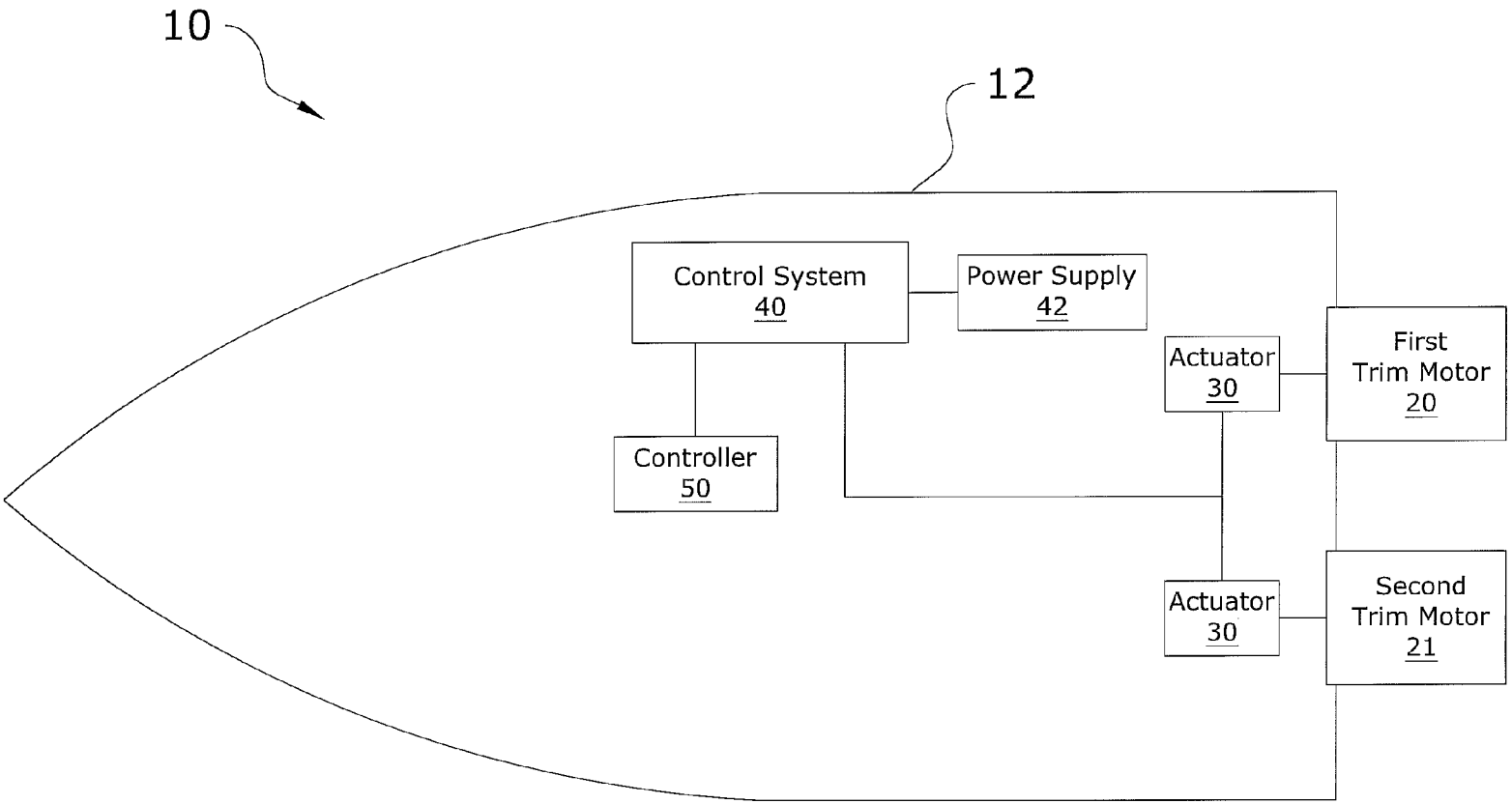
FIG. 8 is a block diagram of a watercraft with one of several possible alternate embodiments, wherein the controller is installed together with the control system in the watercraft and not in a retrofit manner.
Figure 9:
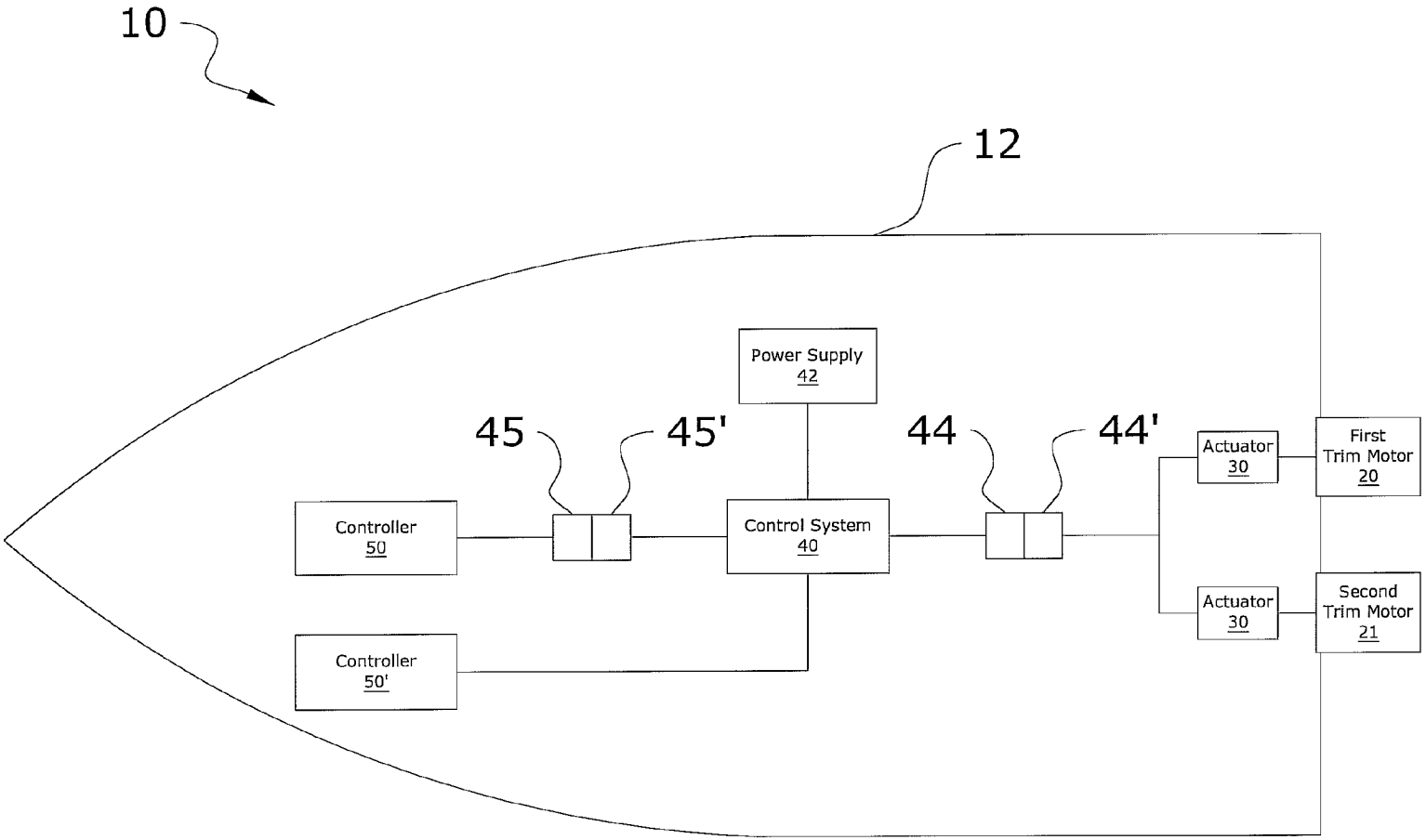
FIG. 9 is a block diagram of a watercraft with an alternate embodiment wherein the watercraft includes multiple input controller devices.
Figure 10:
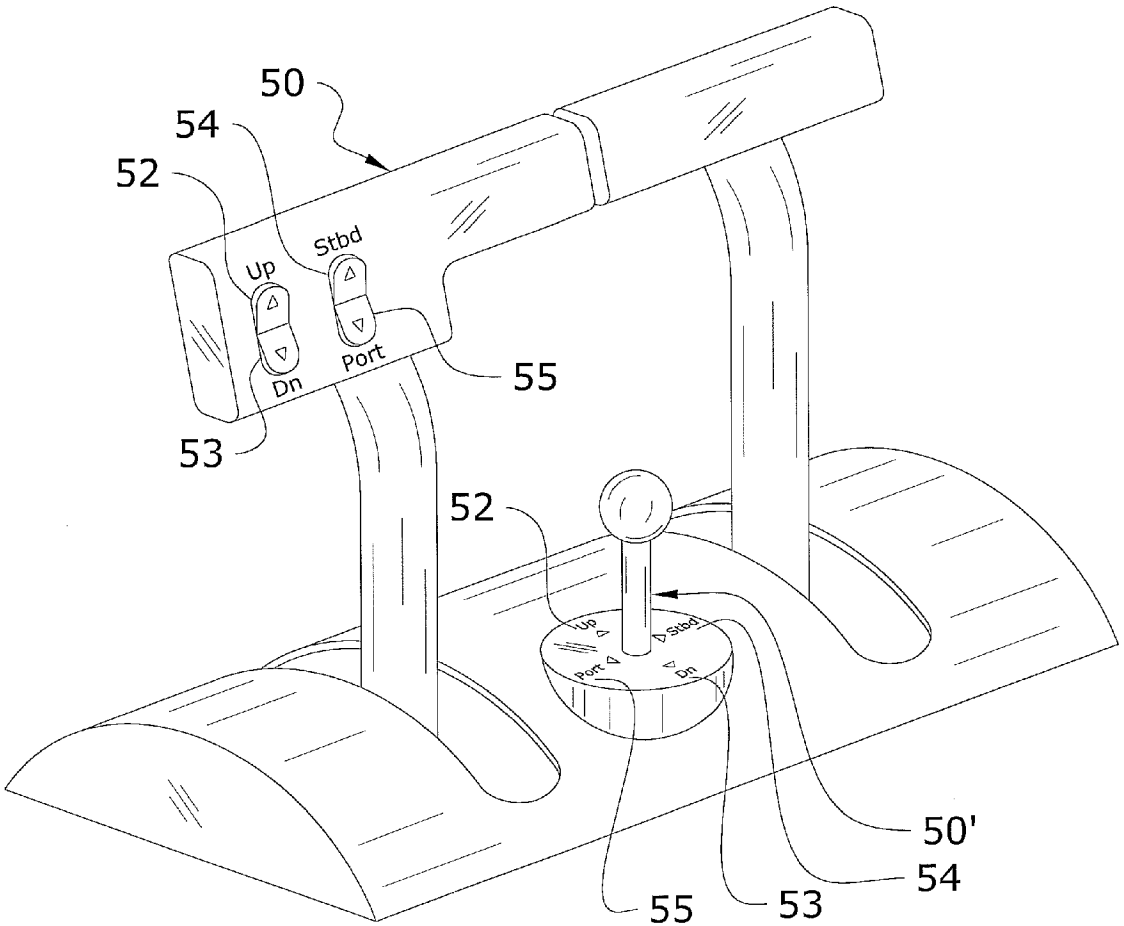
FIG. 10 is an upper perspective view of two potential embodiments of the controller.
Figure 11:
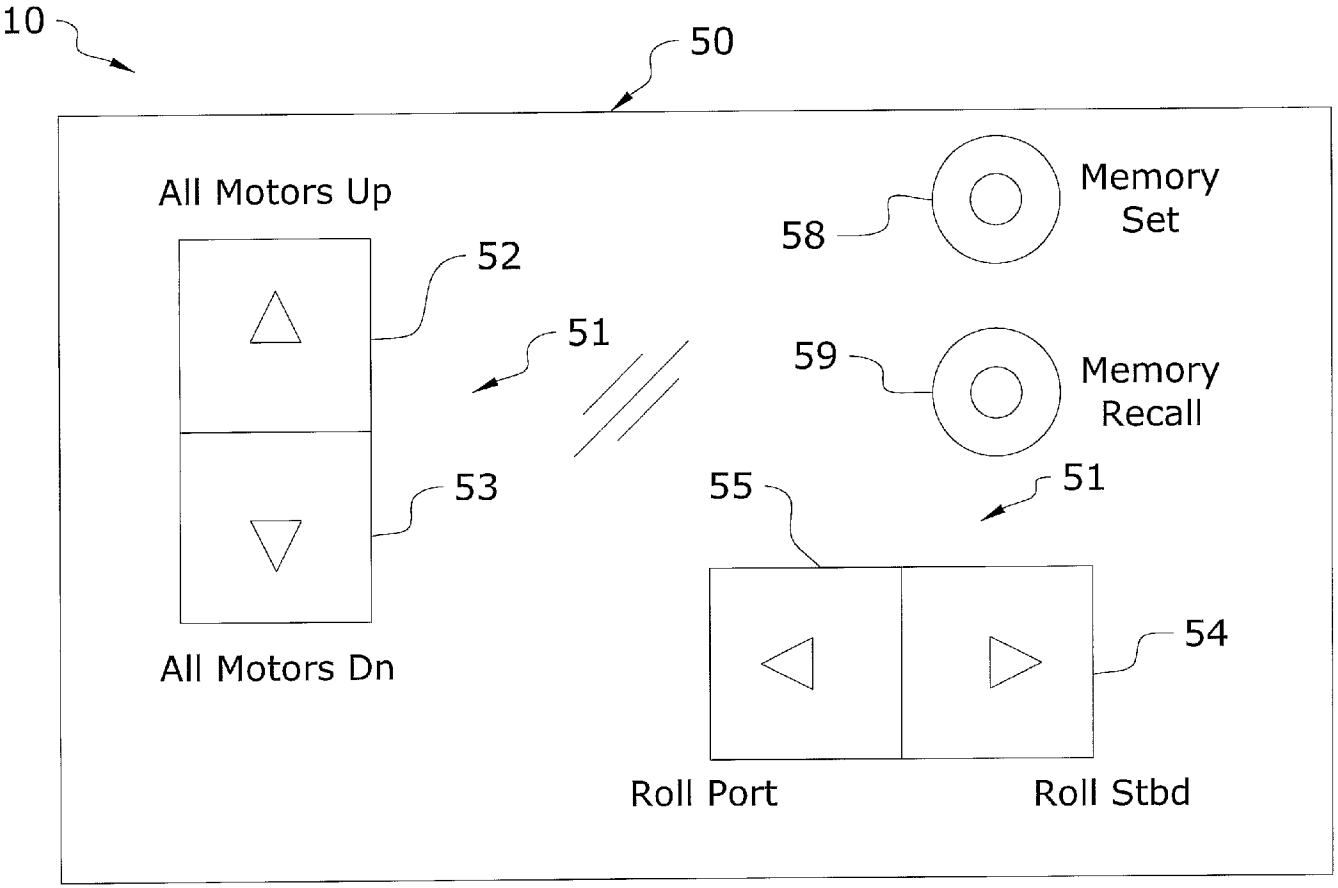
FIG. 11 is an upper perspective view of another embodiment of the controller, wherein the controller is comprised of a pair of rocker switches.

The watercraft 12 also preferably includes a plurality of trim devices 20, 21, 22, 23, wherein the present invention may be utilized to control multiple trim devices 20, 21, 22, 23 (e.g. 2, 3, 4, etc.). The trim devices 20, 21, 22, 23 as described in the present invention may be comprised of various types, such as trim tabs or trim motors such as upon propulsion units (e.g. outboard motors, inboard/outboard motors, jet drives, etc.). The trim devices 20, 21, 22, 23 upon the watercraft 12 may further include a combination of trim tabs and motor trim units as illustrated in FIG. 7, wherein each set of trim motors 20, 21 and trim tabs 22, 23 are connected to a respective controller 40, 40' to operate independently. Another advantage of the multiple trim devices is to enhance a "roll" capability by countering any uneven loading, level the watercraft and to enhance the turning capabilities of the watercraft.

Figure 12:
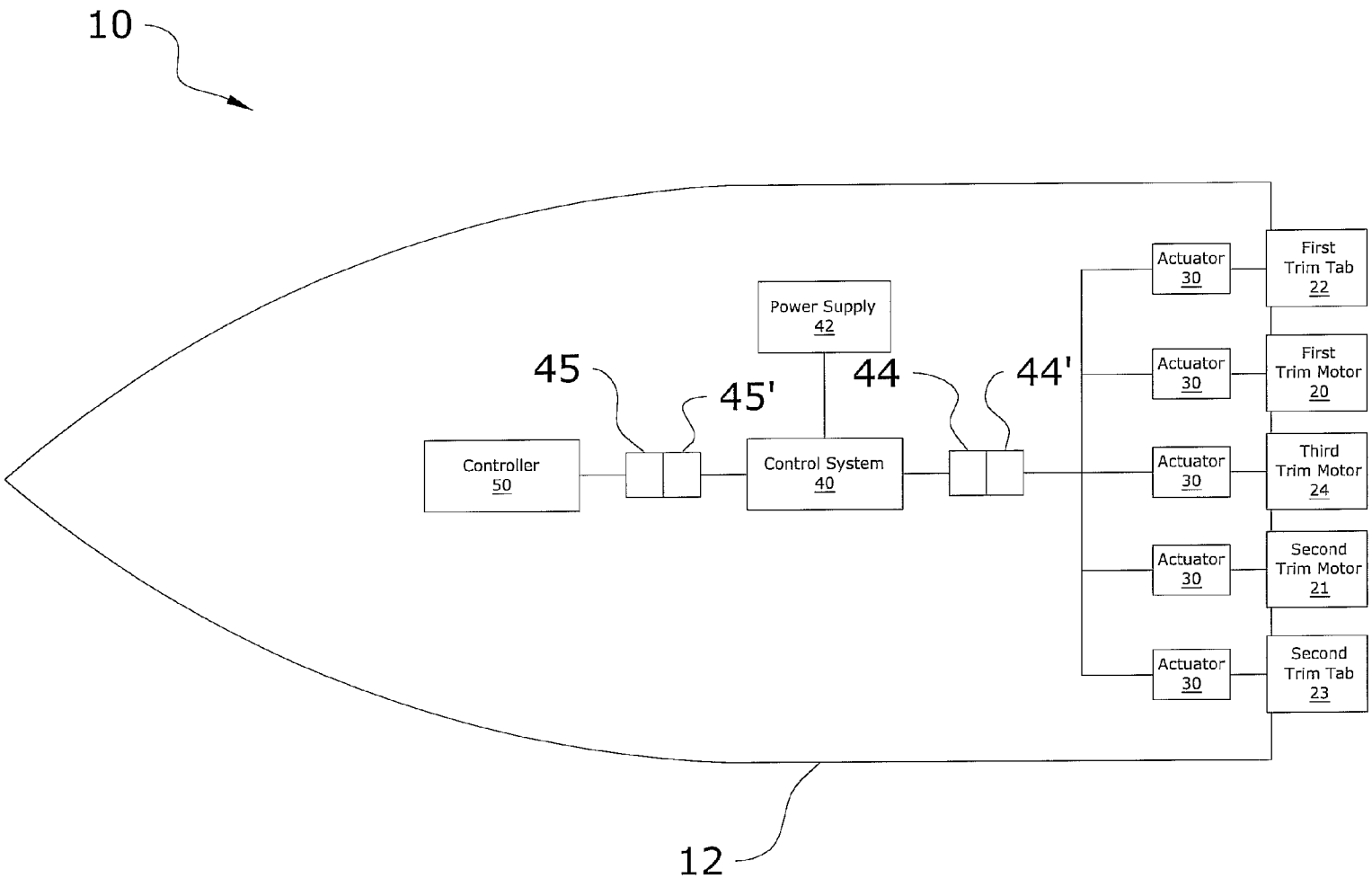
FIG. 12 is another block diagram of an alternate embodiment of the present invention retrofitted to a watercraft and including a plurality of trim tabs and motor trim units.

The trim devices 20, 21, 22, 23 are preferably pivotally attached to the stern end of the watercraft 12 and include at least one actuator 30 to move the trim devices 20, 21, 22, 23 as illustrated in FIG. 7. The actuator 30 may be comprised of various types of actuators 30, such as but not limited to hydraulic actuators 30 or electric actuators 30. The trim devices 20, 21, 22, 23 and the actuators 30 may be connected in various manners common with watercraft 12 including multiple trim devices 20, 21, 22, 23. The present invention may further include a third trim motor 24 (or more than 3 trim motors) to operate with the first trim motor 20 and the second trim motor 21 as illustrated in FIG. 12. It is appreciated that the trim motor 24 would move with the other trim devices in modes 1 and 2 (52 and 53), but would not move in modes 3 and 4 (54 and 55).

In another configuration the watercraft 12 includes a first trim motor 20 upon the starboard side 16, a second trim motor 21 upon the port side 17, a first trim tab 22 upon the starboard side 16 and a second trim tab 23 upon the port side 17. The first trim motor 20 and the first trim tab 22 may adjust towards a similar direction in all the modes or may alter according to a specific setting of the controller 50, 50' (the first trim motor 20 and the first trim tab 22 are preferably operated independently). The same goes for the second trim motor 21 and the second trim tab 23.

D. Control System

The watercraft 12 also includes a control system 40 electrically connected to the actuators 30 of the watercraft 12. The control system 40 includes various types of electronic circuitry which serve to activate the actuators 30 and move the trim devices 20, 21, 22, 23 as desired.

The control system 40 is also electrically connected to a power supply 42. It is appreciated that the power supply 42 may be directly connected to the actuators 30 or trim devices 20, 21, 22, 23. The power supply 42 may be comprised of various configurations, such as but not limited to a 12 volt battery.

The control system 40 may further be connected to the actuators 30 and controller 50 through various types of adapters 44, 44', 45, 45' (e.g. wiring harness, original equipment manufacturer plugs, etc.) configured to withstand contact with water and electrically connected to the controller 50. This connection may also be accomplished through wireless signals, radio signals or in various other manners.

It is appreciated that in alternate embodiments of the present invention a second control system 40' may include adapters 46, 46', 47, 47' to connect to the actuators 30 and the second controller 50'. It is also appreciated that a single unit/device 40, 50 could be directly tied to the actuators 30 for all functions described herein.

E. Controller

The preferred embodiment may include multiple types of controllers 50, wherein the controller 50 of the preferred embodiment is preferably adapted to electrically connect to the control system 40 of a watercraft 12 so as to be able to be utilized among various types and styles of watercraft 12. The controller 50 is also adapted to control the position of the trim devices 20, 21, 22, 23 relative to the boat, such as when the trim devices 20, 21, 22, 23 are pivoted upwards or downwards or a combination of both.

The controller 50 may be further preferably comprised of a control module configuration electrically connecting the controller 50 to the control system 40. The control system 40 may further be configured as an electronic chip or device that causes the preexisting trim control unit of the preexisting controller 50 to adjust the trim devices 20, 21, 22, 23 according to the preferred embodiment (i.e. such as according to the first mode 52, second mode 53, third mode 54 or fourth mode 55). The control system 40 may further include various electronic circuitry configurations including various components (e.g. relays, diodes, computers, PLCs, fly-by-wire, gyro, artificial horizon attitude sensing circuitry, etc.) all which allow the preferred embodiment to function in a preferred manner. The electronic circuitry of the control system 40 is also preferably encased in a waterproof enclosure. The present invention may also include a second controller 50' to control the trim tabs 22, 23 in alternate embodiments of the present invention either separate or attached to the first controller 50 which controls the trim motors 20, 21 (or vice versa).

Figure 2:
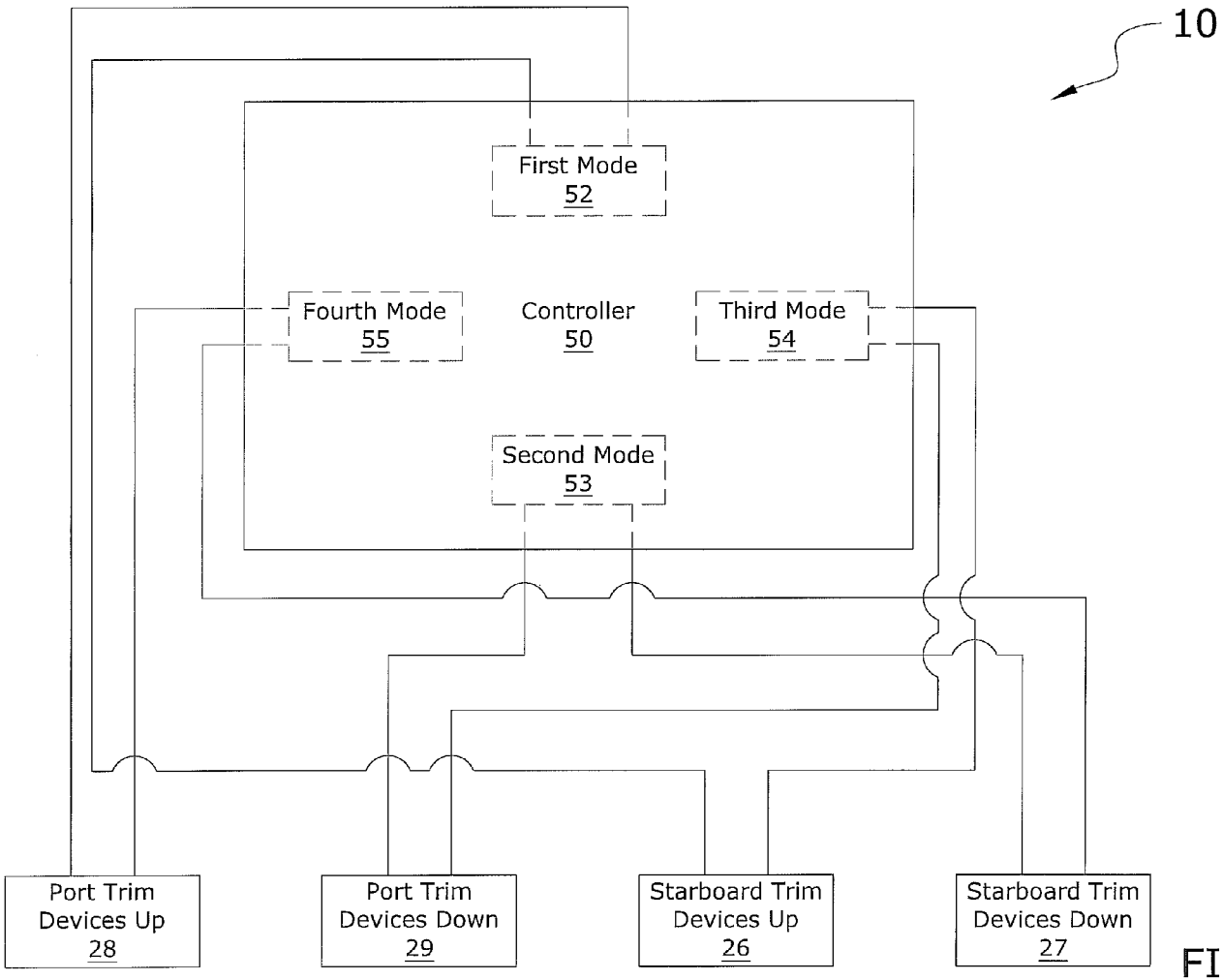
FIG. 2 is a schematic representation of the controller and the adjustment modes corresponding with a particular position of the starboard and port trim devices.

The controller 50 may be comprised of various configurations, such as but not limited to a joystick, rocker switches or various other types. The controller 50 may further include multiple types of displays, thumb and finger controls for one or two hand operation, computers, PLCs, feedback loops or various others. The controller 50 is also preferably adjustable to a plurality of modes, wherein each of the modes 59 adjusts the trim devices 20, 21, 22, 23 toward a desired position. The preferred embodiment preferably includes a first mode 52, a second mode 53, a third mode 54 and a fourth mode 55 as illustrated in FIG. 2.

The first mode 52 and the second mode 53 are utilized to adjust the trim devices 20, 21 or 22, 23 in similar manners, such as when raising or lowering the bow of the watercraft 12. When the controller 50 is adjusted to the first mode 52, the trim devices 20, 21, 22, 23 upon the starboard side 16 and the port side 17 of the watercraft 12 simultaneously begin pivoting upwards thus raising the bow of the watercraft 12. The first mode 52 causes signal to be sent to the trim devices 20, 21, 22, 23. Thus the trim devices 20, 22 upon the starboard side 16 begin moving in a "starboard up" 26 position and the trim devices 21, 23 upon the port side 17 begin moving in a "port up" 28 position in the first mode 52. This movement continues as long as the controller 50 is in the mode 52 or until the trim devices reach their limit of travel.

When the controller 50 is adjusted to the second mode 53, both the trim devices 20, 21 or 22, 23 upon the starboard side 16 and the port side 17 of the watercraft 12 simultaneously begin pivoting downwards thus lowering the bow of the watercraft 12. The second mode 53 causes a signal to be sent to all of the down trim command of the trim devices 20, 21 or 22, 23. Thus the trim devices 20, 22 upon the starboard side 16 begin moving in a "starboard down" 27 position and the trim devices 21, 23 upon the port side 17 begin moving in a "port down" 29 position in the second mode 53. This movement continues as long as the controller 50 is in the mode 53 or until the trim devices reach their limit of travel.

The third mode 54 and the fourth mode 55 are utilized to adjust the trim devices 20, 21 or 22, 23 in opposite manners, such as when rolling the hull 14 of the watercraft 12 in a port or starboard ("stbd" in the Figures) direction. When the controller 50 is adjusted to the third mode 54, the trim devices 20 and/or 22 upon the starboard side 16 of the watercraft 12 being pivoting upwards creating a downward force on the starboard side of the hull 14 of the watercraft 12 thus lowering starboard stern and the trim devices 21 and/or 23 upon the port side 17 of the watercraft 12 simultaneously begin pivoting downwards thus allowing the port side of the hull 14 to raise. The third mode 54 causes a signal to be sent through to at least one up trim device and at least one down trim device. Thus the trim devices 20 and/or 22 upon the starboard side 16 begin moving in a "starboard up" 26 position and the trim devices 21 and/or 23 upon the port side 17 begin moving in a "port down" 29 position in the third mode 54. This movement continues as long as the controller 50 is in the mode 54 or until the trim devices reach their limit of travel.

The fourth mode 55 operates in an opposite manner as the third mode 54. When the controller 50 is adjusted to the fourth mode 55, the trim devices 21, 23 upon the port side 17 of the watercraft 12 are pivoted upwards creating a downward force on the port side of the hull 14 of the watercraft 12 thus lowering the port stern and the trim devices 20, 22 upon the starboard side 16 of the watercraft 12 are simultaneously pivoted downwards thus allowing the right side of the hull 14 to raise. The fourth mode 55 causes a signal to be sent through to at least one up trim device and at least one down trim device. Thus the trim devices 20, 22 upon the starboard side 16 are in a "starboard down" 27 position and the trim devices 21, 23 upon the port side 17 are in a "port up" 28 position in the fourth mode 55. It is further appreciated that each position upon the controller 50 relating to each mode may include a pair of signals (contacts), wherein a first signal of the pair of signals is used for the motor trim units and a second signal of the pair of signals is utilized for the trim tabs.

The controller 50 may further include various other controls associated with controlling the direction in which the trim devices 20, 21, 22, 23 pivot. As an example the controller 50 may include a first control 58 to program a specific position of the trim devices 50. The controller 50 may likewise include a second control 59 to recall the specific position of modes previously programmed by the first control 58. The first control 58 and the second control 59 may be comprised of various configurations, such as but not limited to push button controls. The controller 50 may further include various other switches or controls, such as an on/off switch to revert back to factory trim controls or buttons to initiate a preprogrammed sequence of modes and limited of travel for the trim device with automatic or manual timing.

F. Operation of Preferred Embodiment

In use, the present invention may be installed upon or engineered into a newly manufactured watercraft 12 or may be electrically connected to a controller 50 of a preexisting watercraft 12. After the controller 50 is electrically connected to the control system 40, the controller 50 should be able to pivot the trim devices 20, 21 or 22, 23 via manipulating the controller 50 in a manner described herein with modes 52, 53, 54, 55.

Figure 3:
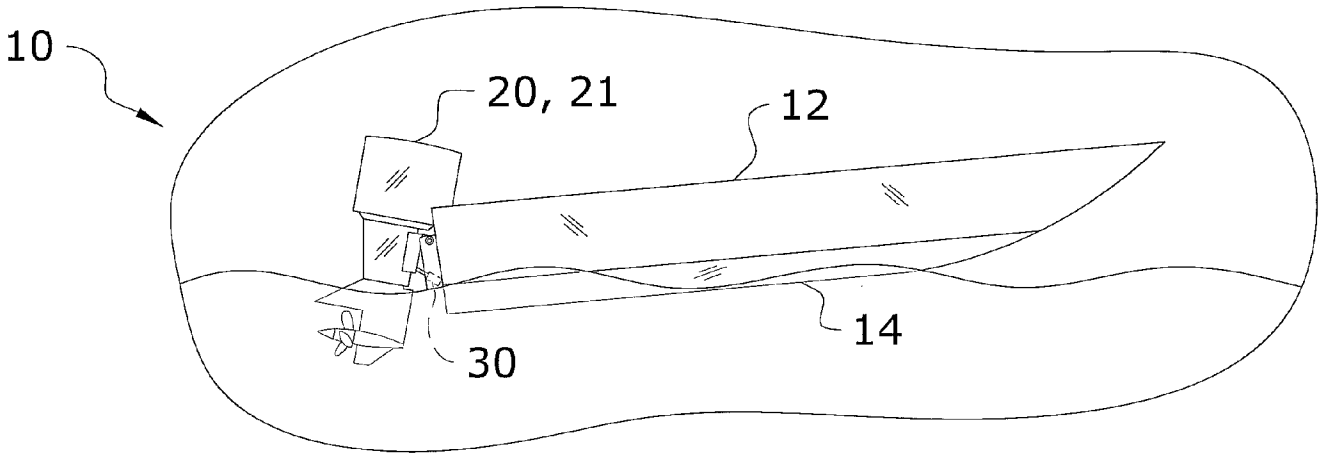
FIG. 3 is a side illustration of a boat with the preferred embodiment momentarily adjusted to the first mode so that the bow of the watercraft is being raised.
Figure 4:
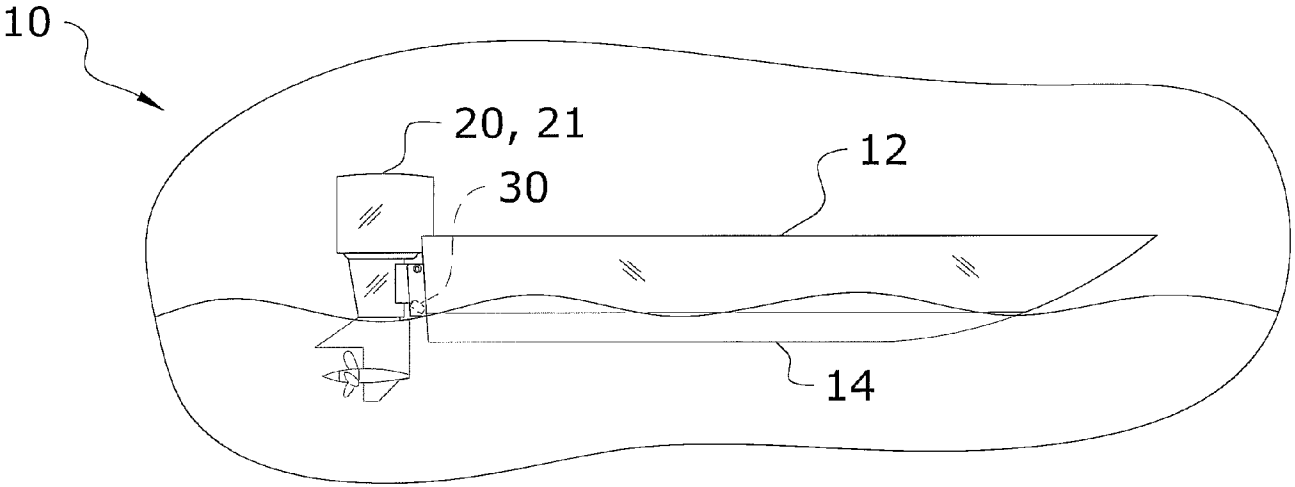
FIG. 4 is a side illustration of a boat with the preferred embodiment momentarily adjusted to the second mode so that the bow of the watercraft is being lowered.
Figure 5A:
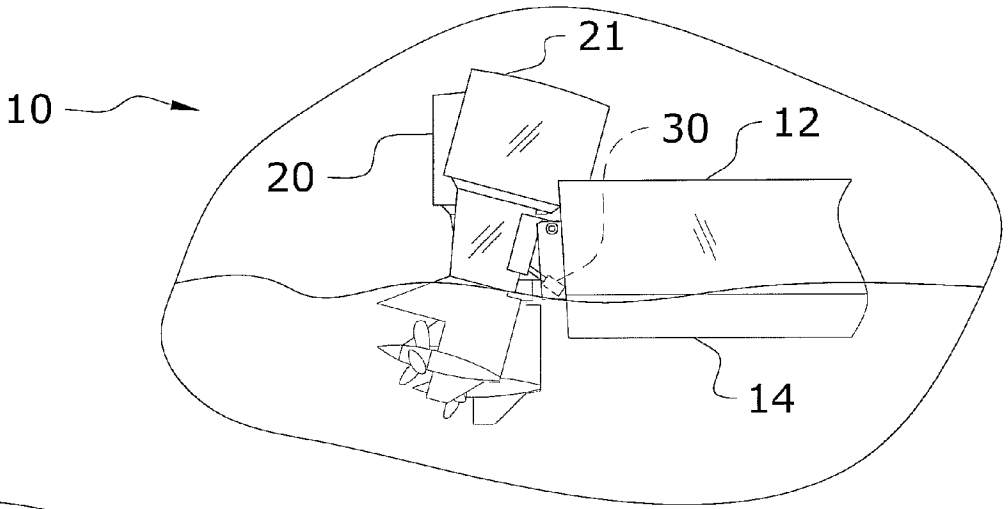
FIG. 5*a* is a side illustration of a boat with the preferred embodiment momentarily adjusted to the third mode so that the watercraft is rolling right.
Figure 5B:
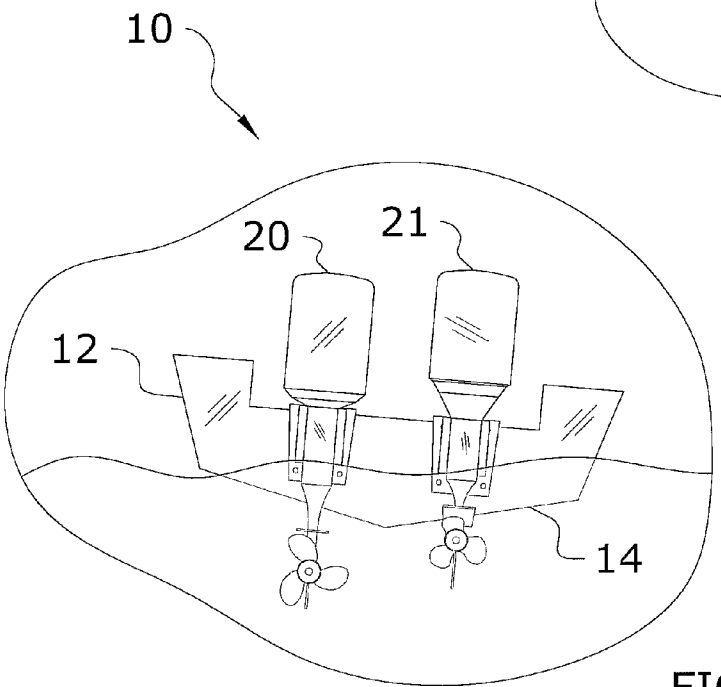
FIG. 5*b* is a rear illustration of the boat in FIG. 5*a*.
Figure 6A:
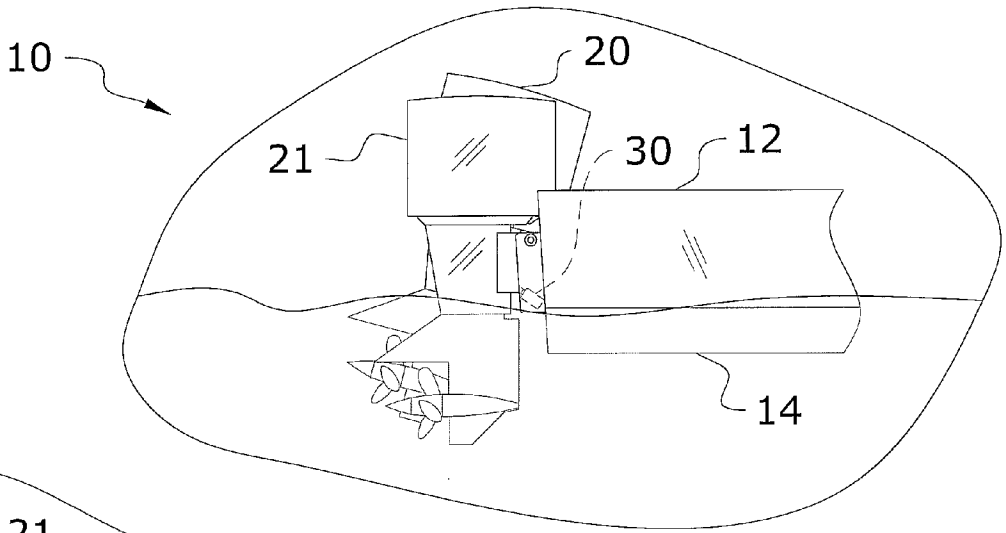
FIG. 6*a* is a side illustration of a boat with the preferred embodiment momentarily adjusted to the fourth mode so that the watercraft is rolling left.
Figure 6B:
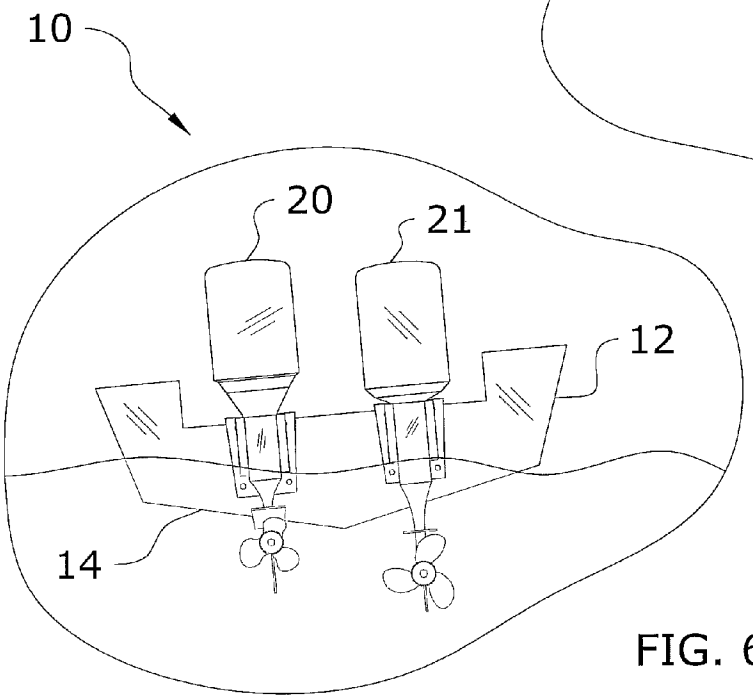
FIG. 6*b* is a rear illustration of the boat in FIG. 6*a*.

When operating the watercraft 12 and desiring to adjust the position of the trim devices 20, 21 or 22, 23 relative to the watercraft 12 to force the watercraft 12 to raise the bow end as illustrated in FIG. 3, lower the bow end as illustrated in FIG. 4, roll the hull 14 starboard as illustrated in FIGS. 5*a* and 5*b* or roll the hull 14 port as illustrated in FIGS. 6*a* and 6*b*, the controller 50 is manipulated to one of the modes (i.e. first mode 52, second mode 53, third mode 54 or fourth mode 55). It is appreciated at any time the operator may disconnect the control system 40 (and reconnect the controller 50 to the actuators 30 via the adapters 44, 44', 45, 45') if the operator desires to utilize the preexisting trim control unit of the watercraft 12. It is also appreciated that either the controller 50 or the control system 40 may be electrically configured to override one or the other.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A Multiple trim modulation system, comprising: a plurality of trim devices movably mounted to a watercraft; wherein said plurality of trim devices includes at least one trim device movably mounted on a port side of said watercraft; and a controller adapted to control said plurality of trim devices; wherein said controller includes a plurality of adjustment modes; wherein each of said plurality of adjustment modes moves said plurality of trim devices in a simultaneous manner;

Wherein at least one mode of said plurality of adjustment modes mode is adapted to move said at least one first trim device and said at least one second trim device similarly toward an upward or downward position to raise or lower a bow of said watercraft;

Where in at least one mode of said plurality of adjustment modes mode is adapted to move said at least one first trim device and said at least one second trim device in an opposite manner upward or downward which creates forces to roll the craft;

Wherein said controller includes a controller adapted to individually select an adjustment mode of said plurality of adjustment modes;

Wherein said controller is adapted to electrically connect to a preexisting control system of said watercraft;

Wherein said controller includes a first control adapted to record a sequence of said plurality of adjustment modes of said controller wherein said controller includes a second control adapted to recall and replay said sequence of modes of said controller.

2. The multiple trim modulation system of claim 1 wherein said control system is removable connected between said plurality of trim devices and said controller via a plurality of adapters.

3. The multiple trim modulation system of claim 1, wherein said controller includes Control adapted to record a position of modes of said plurality of adjustment of controller.

4. The multiple trim modulation system of claim 1, wherein said controller includes a control adapted to recall and replay a position of said plurality of adjustment modes of said controller.

5. The multiple trim modulation system of claim 1, wherein said controller includes a control adapted to individually select an adjustment mode of said plurality of adjustment modes.

6. The multiple trim modulation system of claim 1, wherein said controller is comprised of a joystick input.

7. The multiple trim modulation system of claim 1, wherein said controller includes a control adapted to monitor and record attitude position from an artificial horizon, gyroscopic interface, or other automated self leveling device.

8. The multiple trim modulation system of claim 1, wherein said controller includes a control adapted to automatically through said plurality of modes actively adjust said plurality of devices in order to maintain recorded position.

9. The multiple trim modulation system of claim 1, wherein said controller includes a control adapted to be capable of monitoring steering position for input.

10. The multiple trim modulation system of claim 1, wherein said controller includes a control adapted to Have a sensitivity control input in order for the operator to limit the number of operational adjustments per set time frame to be sent to the plurality of trim devices.

11. The multiple trim modulation system of claim 1, wherein said controller includes a control adapted to Control trim devices individually in an operational mode of adjustment.

12. The multiple trim modulation system of claim 1, wherein said controller includes a control adapted to Automatically retract said plurality of trim devices through ignition kill or operator selection.

13. The multiple trim modulation system of claim 1, wherein said controller includes a control adapted to control hydraulically actuated trim devices.

14. The multiple trim modulation system of claim 1 wherein said controller includes a control adapted to control electrically actuated trim devices.

* * * * *